US006459024B1

(12) United States Patent
Baker

(10) Patent No.: US 6,459,024 B1
(45) Date of Patent: Oct. 1, 2002

(54) STRUCTURAL TORSION BRACE FOR AN ACOUSTIC MUSICAL INSTRUMENT

(75) Inventor: James R. Baker, 17 Dickerson Dr., Shoreham, NY (US) 11786

(73) Assignee: James R. Baker, Shoreham, NY (US)

( * ) Notice: Subject to any disclaimer, the term of this patent is extended or adjusted under 35 U.S.C. 154(b) by 0 days.

(21) Appl. No.: 08/933,542

(22) Filed: Sep. 19, 1997

(51) Int. Cl.[7] ..... G10D 3/00
(52) U.S. Cl. ..... 84/291; 84/290
(58) Field of Search ..... 84/267, 290–293, 84/274–275

(56) References Cited

U.S. PATENT DOCUMENTS 5,339,718 A * 8/1994 Leduc ..... 84/291
5,895,872 A * 4/1999 Chase ..... 84/291

OTHER PUBLICATIONS

EZ Dock, Inc v. Schafer Systems, US court of Appeals for the Federal Circuit, decided Jan. 15, 2002.*
Group One, Ltd. v. Hallmark Cards, Inc. US Court of Appeals ofr the Federal Circuit, decided Jun. 15, 2001.*

* cited by examiner

*Primary Examiner*—Marlon T. Fletcher

(57) ABSTRACT

An acoustic instrument is provided with a torsion brace which contacts the upper and lower plates in only three locations. The first location is at the head of the body, the second is at the heel of the body, and the third is where the bridge connects to the upper plate. This arrangement provides structural support to the guitar body because it braces the head and heel of the body and also supports the upper plate where the bridge is attached. However, because the brace contacts the plates at its neck and heel and at the bridge the plates may vibrate freely. This structure has been shown to resist feedback, yet does not dampen the vibration of the plates. As a result, the sound, projection, and sustain of the guitar are not adversely affected.

9 Claims, 3 Drawing Sheets

STRUCTURAL TORSION BRACE FOR AN ACOUSTIC MUSICAL INSTRUMENT

BACKGROUND OF THE INVENTION

1. Field of the Invention

The present invention relates to musical instruments. More particularly, the present invention relates to a structural, suspended torsion brace for use in acoustic musical instruments, such as archtop guitars.

2. Discussion of Related Art

Hollow body guitars, such as archtop guitars, are well known. FIG. 1 illustrates the body 100 of a typical archtop guitar; FIG. 2 is a side cutaway view of the body 100. In a hollow body guitar, sound is generated by the vibration of strings connected to a bridge 102. The bridge 102 is connected to the hollow body 100. To aid in the generation, amplification, and projection of the sound made by the string vibration, the hollow body 100 includes a chamber which is typically defined by an upper plate 104, to which the bridge 102 is connected, a lower plate 106 (see FIG. 2), and a side 107. The upper and lower plates 104, 106 are connected to side 107. In an archtop guitar as seen in FIGS. 1 and 2, the upper plate 104 is slightly arched. The upper 104 and lower plates 106 vibrate in response to the vibration of strings 108 (for simplicity of illustration, the strings are only seen in FIG. 2). One or more sound holes 110 may be provided to project the sound from the chamber.

To generate sound, the strings 108 are kept taut and may be depressed along a fret board 112 (partially seen in FIGS. 1 and 2) to adjust the strings' length and thus the frequency of the vibration when a string is plucked or strummed. The fret board 112 is connected to the front, or head, of the guitar body 100. The strings 108 are connected to the bridge 102, which transfers the vibrations of the string to the hollow body. The strings 108 may also be anchored by a tailpiece 114, which is typically connected to the end, or heel, of the guitar body 100. Because of the pressure placed on the guitar body from the taut strings, one or more rigid braces 116 are typically glued to the upper plate 104 and/or lower plate 106 of the guitar body. Blocks 118, 120 may be placed at the head and heel to provide support to the body.

Hollow body guitars suffer from several drawbacks. One major drawback associated with amplified hollow body guitars is feedback. During a performance, the amplified sound of the guitar may vibrate the upper and/or lower plates 104, 106. Because these vibrations are the amplification of the sound generated by the guitar, the result is feedback, which when uncontrolled, is undesirable. Note that solid body guitars (i.e., guitars in which the body is a solid piece of wood or other material) do not suffer from the feedback problem to the same extent as hollow body guitars.

Several solutions to the feedback problem in hollow body guitars have been proposed. One solution is to make the upper and/or lower plates thicker. A second solution is to remove the sound hole. A third solution is to add more bracing to the upper and lower plates. All of these solutions tend to dampen the vibration of the plates. Although these solutions do minimally reduce feedback, because they dampen vibration they also adversely affect the guitar's sound, projection, and sustain (the amount of time a note will sound).

Therefore, it is an object of the present invention to provide an improved acoustic musical instrument which decreases feedback.

It is a further object of the present invention to provide a torsion brace which does not dampen the vibrations of the plates.

SUMMARY OF THE INVENTION

These and other objects of the present invention are provided by an acoustic instrument having a structural torsion brace according to the present invention. In a preferred embodiment of the present invention an acoustic instrument is provided with a torsion brace which contacts the upper and lower plates in only three locations. The first location is at the head of the body, the second is at the heel of the body, and the third is where the bridge connects to the upper plate.

This arrangement provides structural support to the guitar body because it braces the head and heel of the body and also supports the upper plate where the bridge connects to it. However, because the brace contacts the plates only at its head, heel, and bridge, the plates may vibrate freely. This structure has been shown to resist feedback, yet does not dampen the vibration of the plates. As a result, the sound, projection, and sustain of the guitar are not adversely affected.

BRIEF DESCRIPTION OF THE DRAWINGS

The present invention is described with reference to the following figures.

DETAILED DESCRIPTION OF PREFERRED EMBODIMENTS

Figure 1:
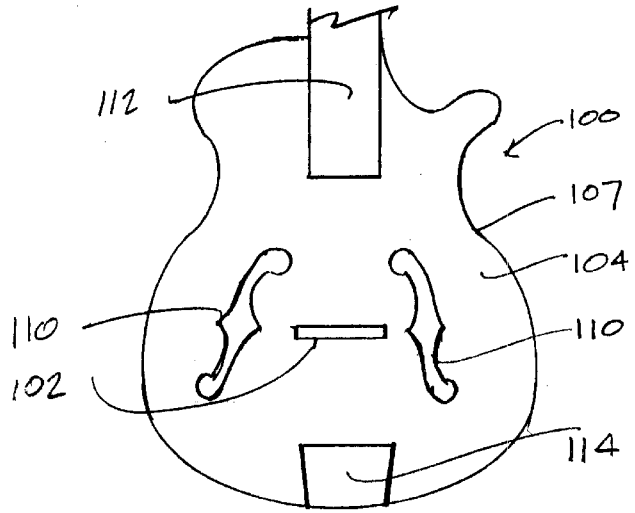
FIG. 1 (PRIOR ART)
FIG. 1 is a front elevational view of a hollow guitar body.
Figure 2:
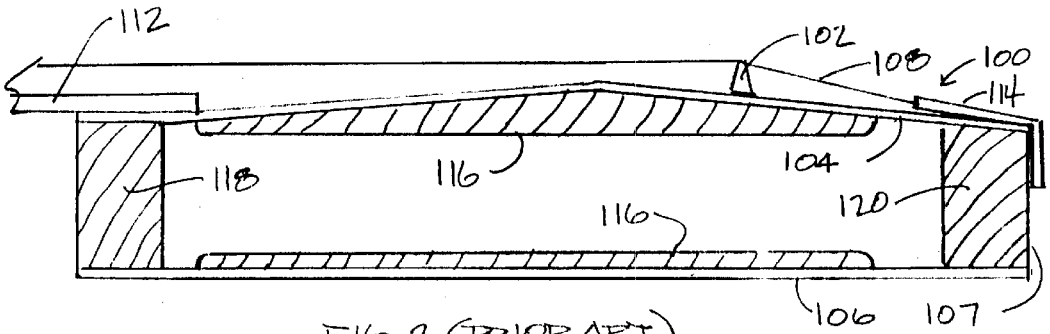
FIG. 2 (PRIOR ART)
FIG. 2 is a side cutaway view of the hollow guitar body of FIG. 1.
Figure 3:
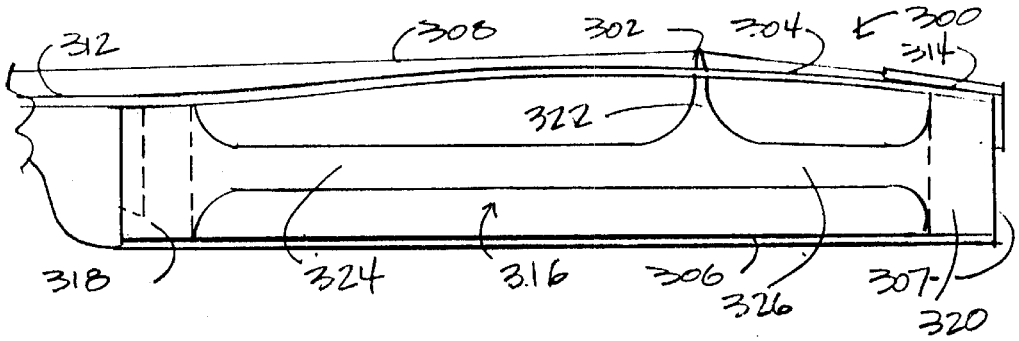
FIG. 3 is a side cutaway view of a hollow guitar body according to a preferred embodiment of the present invention.
Figure 4:
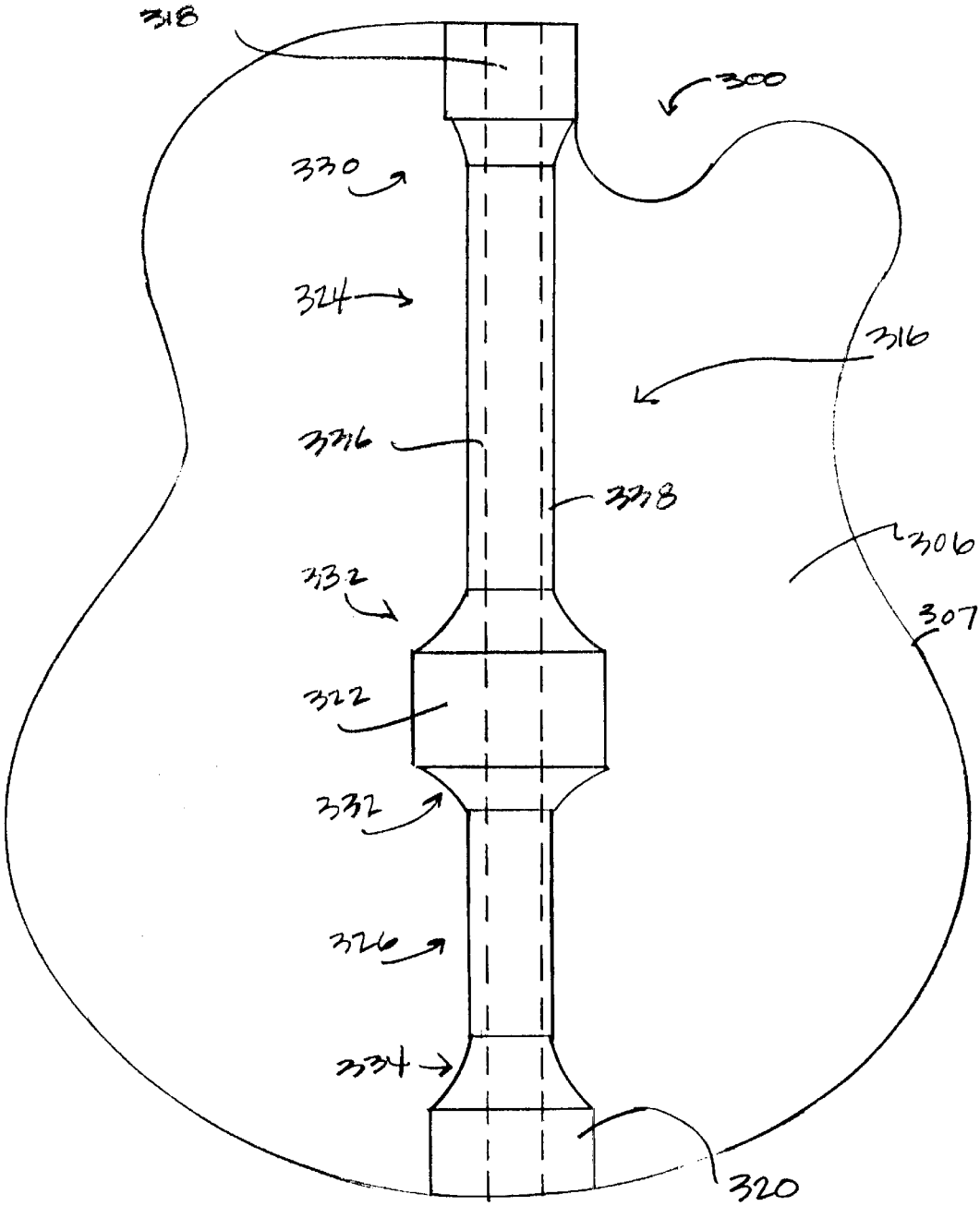
FIG. 4 is a front elevational view of a hollow guitar body according to a preferred embodiment of the present invention with the upper plate removed.
Figure 5:
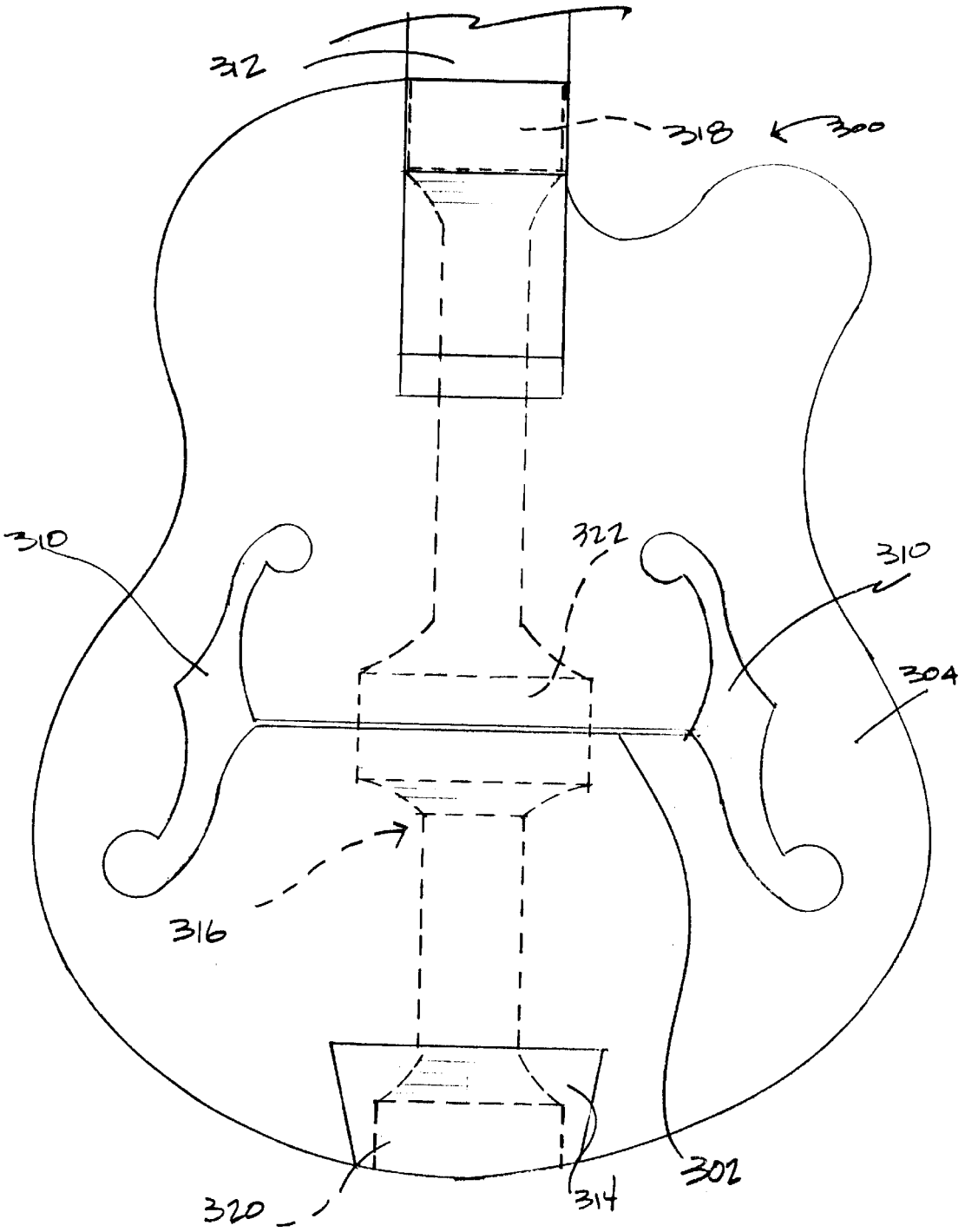
FIG. 5 is a front elevational view of a hollow guitar body according to a preferred embodiment of the present invention with the torsion bar illustrated in phantom.

FIG. 3 is a side cutaway view of a hollow guitar (or other acoustic instrument) body 300 according to a preferred embodiment of the present invention. As seen in FIGS. 3, 4, and 5, an archtop guitar body 300 has a bridge 302, an upper plate 304, a lower plate 306, a side portion 307, sound holes 310 (see FIG. 5), a fret board 312, and a tailpiece 314, each of which may be of conventional design. The body 300 also has a torsion brace 316 according to a preferred embodiment of the present invention.

As seen in FIGS. 3, 4, and 5, the torsion brace is located in the chamber and extends through the entire hollow body 300. The torsion brace 316 is connected to the body at only three locations. The torsion brace has a head portion 318, a heel portion 320, a bridge support portion 322, an upper connection portion 324, and a lower connection portion 326.

The head portion 318 provides support to the upper plate 304 and lower plate 306 near the head. The heel portion 320 provides support to the upper plate 304 and lower plate 306 near the tail. Because the torsion brace extends throughout the body and is connected to the head and tail, the brace also provides support to the entire body 300.

The bridge support portion 322 performs two functions. The first function is to provide structural support to the upper plate 304 to withstand the pressure exerted by the stings 308 contacting the bridge 302. The second function is to reduce feedback. The inventor believes that this second function is provided in the following manner. The upper plate 304 is the source (or "center") of the feedback vibrations, which are waves. The location of the bridge support portion controls feedback vibrations within the chamber by breaking the geometric pattern of the feedback vibrations within the chamber. This is done without interfering with the resultant increased projection of the desired vibrations (sound waves) from the instrument, because the vibration of the upper 304 and lower plates 306 is not dampened, nor is there a need to eliminate the sound holes 310.

The upper connection portion 324 connects the head portion 318 and bridge support portion 322 without contacting the upper or lower plates 304, 306. Similarly, the lower connection portion 326 connects the bridge support portion 322 with the heel portion 320 without contacting the upper or lower plates 304, 306. In this way, support is provided to the body 300 without unduly dampening the vibration of plates 304, 306, yet breaks up the geometric pattern of any feedback vibrations in the chamber. Because it may be desirable for the connecting portions 324, 326 to be thinner than the head, heel, and bridge support portions 318, 320, 322 (for reasons described below) the torsion brace may include curved portions 330, 332, 334 which taper from the head, neck, or bridge support portions to the connection portions.

A preferred embodiment of the inventive torsion brace is made of a material which is conducive to propagating sound waves, such as a tonewood. A preferred tonewood is mahogany, cedar, or spruce. The torsion brace may have laminations 336, 338 (illustrated in FIG. 4 by dashed lines). These laminations 336, 338 run longitudinally along the length of the torsion brace and provide structural integrity to the torsion brace. The laminations 336, 338 are preferably also made of a tonewood, and preferably the same material as the upper plate 304. The laminations 336, 338 are preferably the same material as the upper plate 304 because they will vibrate in a sympathetic wavelength with the upper plate 304. Preferred lamination materials include spruce, mahogany and cedar. The torsion brace 316 may be connected to the head, heel, and bridge area in a conventional manner such as gluing.

The thickness and curvature of the torsion brace 316 may be adjusted depending on the desired sound of the instrument. The greater the thickness (and/or more curvature) of the torsion brace 316, the greater the ability to prevent feedback. This is because the thicker brace breaks up the feedback waves in the chamber effectively. A thinner torsion brace 316 provides a more "acoustic" sound and may be more desirable, depending on the musician's preference.

The above described embodiments of the invention are intended to be illustrative only. Numerous alternative embodiments may be devised by those skilled in the art without departing from the spirit and scope of the following claims. For example, the invention has been described with respect to an archtop guitar. It is obvious to a person skilled in the art that the invention may be used in any number of chambered stringed instruments, such as mandolins, bouzoukis, violins, violas, cellos, dobros, resonators, and other instruments subject to feedback when amplified.

I claim:

1. A torsion brace for a musical instrument having a hollow body, the body having an upper plate and a lower plate, the upper and lower plates connected to a side portion, the torsion brace comprising:

a. a head portion configured to connect to the upper plate, lower plate, and side portion at a head of the body;

b. a bridge support portion connected to the upper plate at a location where a bridge connects to the upper plate;

c. a heel portion configured to connect to the upper plate, lower plate, and side portion at a heel of the body;

d. an upper connection portion connected between the head portion and the bridge support portion without contacting the upper plate, lower plate, and side portion; and e. a lower connection portion connected between the heel portion and the bridge support portion without contacting the upper plate, lower plate, and side portion.

2. The torsion brace of claim 1, wherein the torsion brace is made of a material conducive to propagating sound waves.

3. The torsion brace of claim 1, wherein the torsion brace is made of a tonewood.

4. The torsion brace of claim 1, wherein the torsion brace is made at least one of mahogany, cedar, and spruce.

5. The torsion brace of claim 1, wherein the torsion brace further includes laminations along a length of the torsion brace.

6. The torsion brace of claim 5, wherein the laminations are made of a tonewood.

7. The torsion brace of claim 5, wherein the laminations are made of at least one of mahogany, cedar and spruce.

8. The torsion brace of claim 5, wherein the laminations are made of a same material as the upper plate.

9. A musical instrument having a hollow body, the body comprising:

a. an upper plate;

b. a lower plate;

c. a side portion connected between the upper plate and the lower plate, the upper plate, lower plate, and side portion defining a chamber;

d. a bridge connected to the upper plate and configured to receive at least one string; and e. a torsion brace located in the chamber and comprising:

(1) a head portion configured to connect to the upper plate, lower plate, and side portion at a head of the body;

(2) a bridge support portion connected to the upper plate at a location where the bridge connects to the upper plate;

(3) a heel portion configured to connect to the upper plate, lower plate, and side portion at a heel of the body;

(4) an upper connection portion connected between the head portion and the bridge support portion without contacting the upper plate, lower plate, and side portion; and (5) a lower connection portion connected between the heel portion and the bridge support portion without contacting the upper plate, lower plate, and side portion.

* * * * *